US010933434B1

(12) United States Patent
Pfanstiehl

(10) Patent No.: US 10,933,434 B1
(45) Date of Patent: Mar. 2, 2021

(54) SPRAY HEAD BODY EXTENSION

(71) Applicant: John Pfanstiehl, Indian Rocks Beach, FL (US)

(72) Inventor: John Pfanstiehl, Indian Rocks Beach, FL (US)

( * ) Notice: Subject to any disclaimer, the term of this patent is extended or adjusted under 35 U.S.C. 154(b) by 66 days.

(21) Appl. No.: 16/266,853

(22) Filed: Feb. 4, 2019

(51) Int. Cl.

| | |
|---|---|
| ***B05B 15/68*** | (2018.01) |
| ***B05B 15/18*** | (2018.01) |
| ***B05B 15/16*** | (2018.01) |
| ***B05B 15/622*** | (2018.01) |
| ***B05B 15/628*** | (2018.01) |

(52) U.S. Cl.
CPC ..... *B05B 15/68* (2018.02); *B05B 15/16* (2018.02); *B05B 15/18* (2018.02); *B05B 15/622* (2018.02); *B05B 15/628* (2018.02)

(58) Field of Classification Search
CPC ..... B05B 15/68; B05B 15/628; B05B 15/622; B05B 15/16; B05B 15/18
USPC ..... 239/203–206, 280–281, 580, 600
See application file for complete search history.

(56) References Cited

U.S. PATENT DOCUMENTS 4,479,611 A 10/1984 Galvis
5,687,909 A 11/1997 Dean
6,193,168 B1 * 2/2001 Bedford ..... B05B 15/65 239/204
6,260,575 B1 * 7/2001 Brown ..... F16K 17/34 137/519.5
6,488,218 B1 * 12/2002 Townsend ..... B05B 15/74 239/205
6,530,531 B2 3/2003 Butler
6,547,159 B1 * 4/2003 Westby ..... B05B 15/60 239/204
7,472,840 B2 1/2009 Gregory
8,074,897 B2 12/2011 Hunnicutt et al.

OTHER PUBLICATIONS http://store.rainbird.com/1800ext-1800-extension.html Spray stem extension show on Rain Bird website1800EXT part number.
Rain Bird 1800 Series Spray Heads "The #1 Irrigation Spray Head in the World" http://www.rainbird.com/products/1800-series-spray-heads.

* cited by examiner

*Primary Examiner* — Steven J Ganey

(57) ABSTRACT

A spray head body extension that is screwed onto the upper end of a spray head body after the cap is removed. The cap is then reinstalled on the extension to raise the effective height of the a spray head body and its spray pattern. The spray head body extension permits fast, easy raising of a sunken in-ground spray head without having to dig below the spray head's water supply. A one-piece embodiment uses a compressible gasket to enable the extension to be tightened to the body until the internal guide splines of both the extension and body are aligned. A set screw can be employed to preserve alignment when the cap is reinstalled. An alignment tool helps align the splines of the extension to the body during installation. A multi-piece embodiment enables the extension to be aligned to the body before a separate collar nut is tightened.

7 Claims, 9 Drawing Sheets

Prior Art

Prior Art

Prior Art

SPRAY HEAD BODY EXTENSION

CROSS-REFERENCE TO RELATED APPLICATIONS

U.S. Provisional Patent Application 62/626,452

FEDERALLY SPONSORED RESEARCH

None

THE NAMES OF THE PARTIES TO A JOINT RESEARCH AGREEMENT

None

SEQUENCE LISTING

None

FIELD OF THE INVENTION

The present invention relates to irrigation sprinkler spray heads, and more specifically to pop-up sprinkler spray heads. Common examples are the sprinkler spray heads used for watering lawns.

BACKGROUND OF THE INVENTION

Pop-up sprinkler spray heads are comprised of a body, a cap that screws on top of the body, and a spray stem that goes through the cap. The spray head is typically buried in the soil with its cap at the top surface of the soil so that it is less visible, it is less likely to trip people, and it is less likely to be damaged by lawn mowers or vehicles. When water pressure is applied to the spray head, the spray stem extends upward from the cap to spray water over the grass and the soil.

Over time, the soil and grass thatch build up over and around the spray head. This sunken spray head creates a number of problems. The increased relative height of the soil and the grass to the spray head will block the water spray, thereby defeating the spray head's purpose. Secondly, the accumulated soil can prevent the spray stem from extending, also preventing proper watering of the nearby lawn, or prevent the spray stem from retracting. Thirdly, dirt and sand build up on the cap causing accelerated wear on the wiper seal in the cap that the spray stem slides through.

The most common procedure to repair a sunken spray head's functionality is to install a longer nipple or threaded pipe under the spray head. This requires digging a fairly large hole around and under the spray head. Sufficient soil must be removed so that digging is possible under the spray head's connection to the water supply. If the hole is not dug deep enough and wide enough, dirt and sand can fall into the water supply connection when the spray head is removed. Digging a hole this large is time-consuming, particularly when the soils are rocky, are compacted or are mostly composed of clay.

Additionally, the newly dug hole may fill with water as the water supply empties when the spray head is removed. It may take an hour or more in hard soils for the water to drain back down under the spray head supply connection to permit cleaning of the threads and to avoid soil contamination in the system.

Furthermore, digging a sufficiently large hole necessitates that a sizeable amount of grass must be cut out and removed, which may kill much of the grass.

If flexible pipe such as 'funny' pipe is connected to the spray head, a ditch must be dug along the supply pipe to permit the spray head to be raised sufficiently and to be positioned at the desired angle. This repair procedure shares the same problems with the previous repair procedure: it can take considerable time and it can damage the surrounding grass.

In an attempt to solve this problem, Rain Bird® produced spray stem extension part number 1800EXT that is screwed onto the top of the spray stem after removing the spray nozzle. The nozzle is then screwed onto the spray stem extension. This enables a sunken spray head to once again spray water over the top of the grass, but it creates the following critical problems.

The spray nozzle and nearly all of the spray stem extension do not retract into the spray head. The permanently raised spray stem extension therefore presents a trip hazard for people and pets.

Additionally, the spray stem extension is always extending above the spray head when the water supply is off. Therefore the spray stem extension is always very vulnerable to damage from vehicles, lawn mowers and weed-wackers.

Furthermore, the spray stem extension does not solve the problem of the dirt and sand covering the cap and jamming the spray stem and prematurely wearing out the wiper seal between the cap and the spray stem.

The present invention discloses a novel structure and method that satisfies all the above deficiencies of previous procedures and previous products directed at this particular long-felt need.

SUMMARY OF THE INVENTION

The present invention is a new device that enables a fast, efficient, low-cost method of solving the common problem of sunken spray head repairs. The advantages of the present invention include:

a) enabling the fast and easy upward extension of a spray head when the spray head is too low in the ground;

b) raising the effective height of the spray head without the need to dig and remove the ground under the spray head;

c) raising the effective height of the spray head by raising the effective body height so that the spray stem can fully retract and therefore is not exposed to damage when not in use;

d) raising the height of the spray head cap by raising the effective body height so that the wiper seal is above the surrounding ground and thereby less likely to be jammed or prematurely worn by dirt or sand; and e) raising the effective height of the spray head quickly and easily while preventing dirt and sand from contaminating the inside of the spray head or water supply.

These improvements have not been and are not now obvious in view of the prior art taken as a whole to one of ordinary skill in this art.

BRIEF DESCRIPTION OF THE DRAWINGS

For a fuller understanding of the nature and the objects of the invention, reference should be made to the following detailed description, taken with the accompanying drawings, in which.

DETAILED DESCRIPTION OF EXEMPLARY EMBODIMENTS OF THE INVENTION

Figure 1:
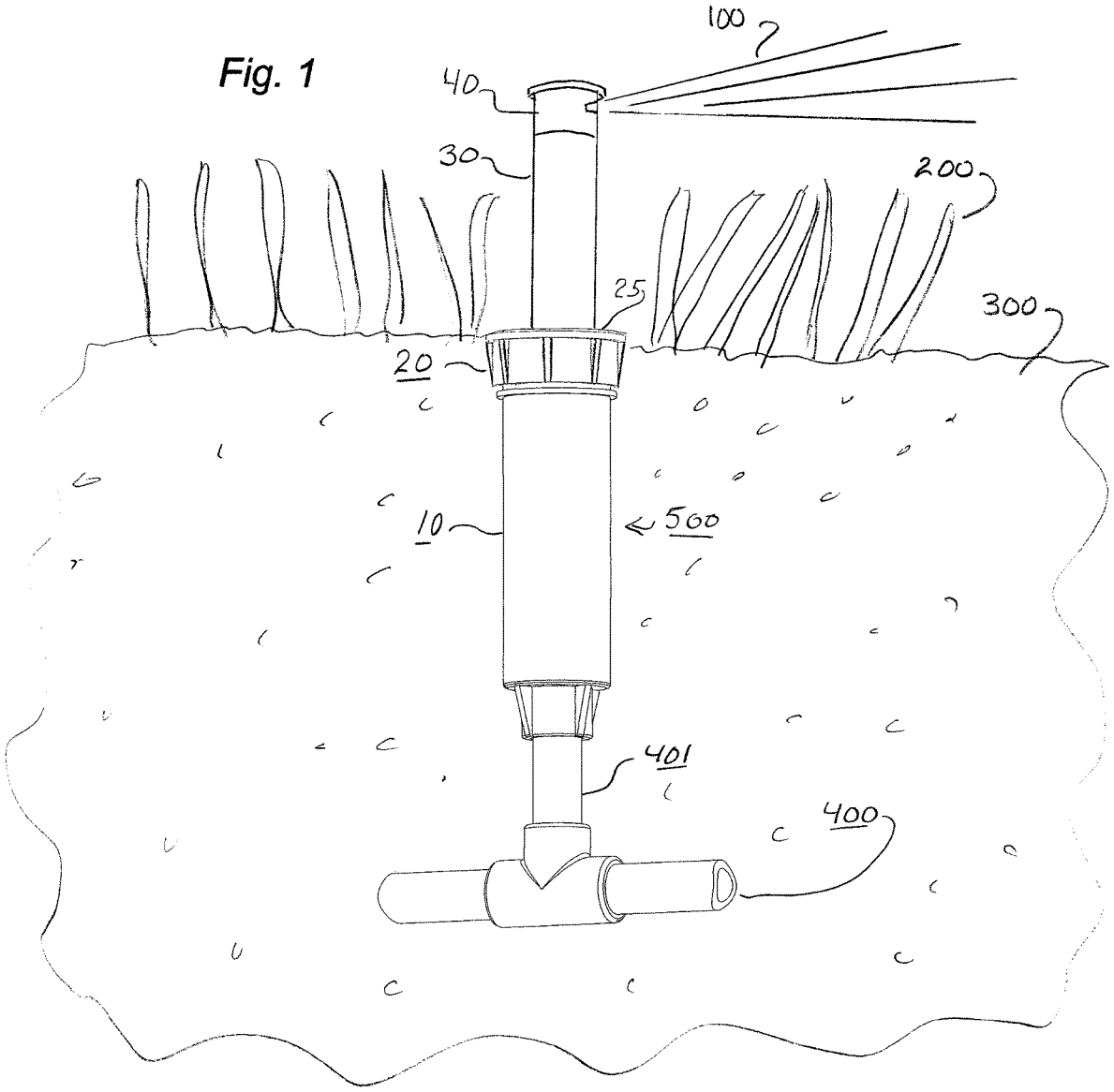
FIG. 1 is a side view illustrating a spray head installed at the proper depth in a lawn and with its pop-up spray stem extended.

FIG. 1 illustrates a spray head 500 comprised of a body 10, a cap 20, a pop-up spray stem 30, and a nozzle 40. The spray stem slides through a wiper seal 25 that is a component of the cap. Spray head 500 is connected to a water supply 400 by a pipe nipple 401. Spray head 500 is installed at the proper depth in soil 300 when cap 20 is at the same height as the top surface of soil 300 enabling water spray 100 to be directed over the adjacent grass 200 when spray stem 30 is in its extended position as shown.

Figure 2:
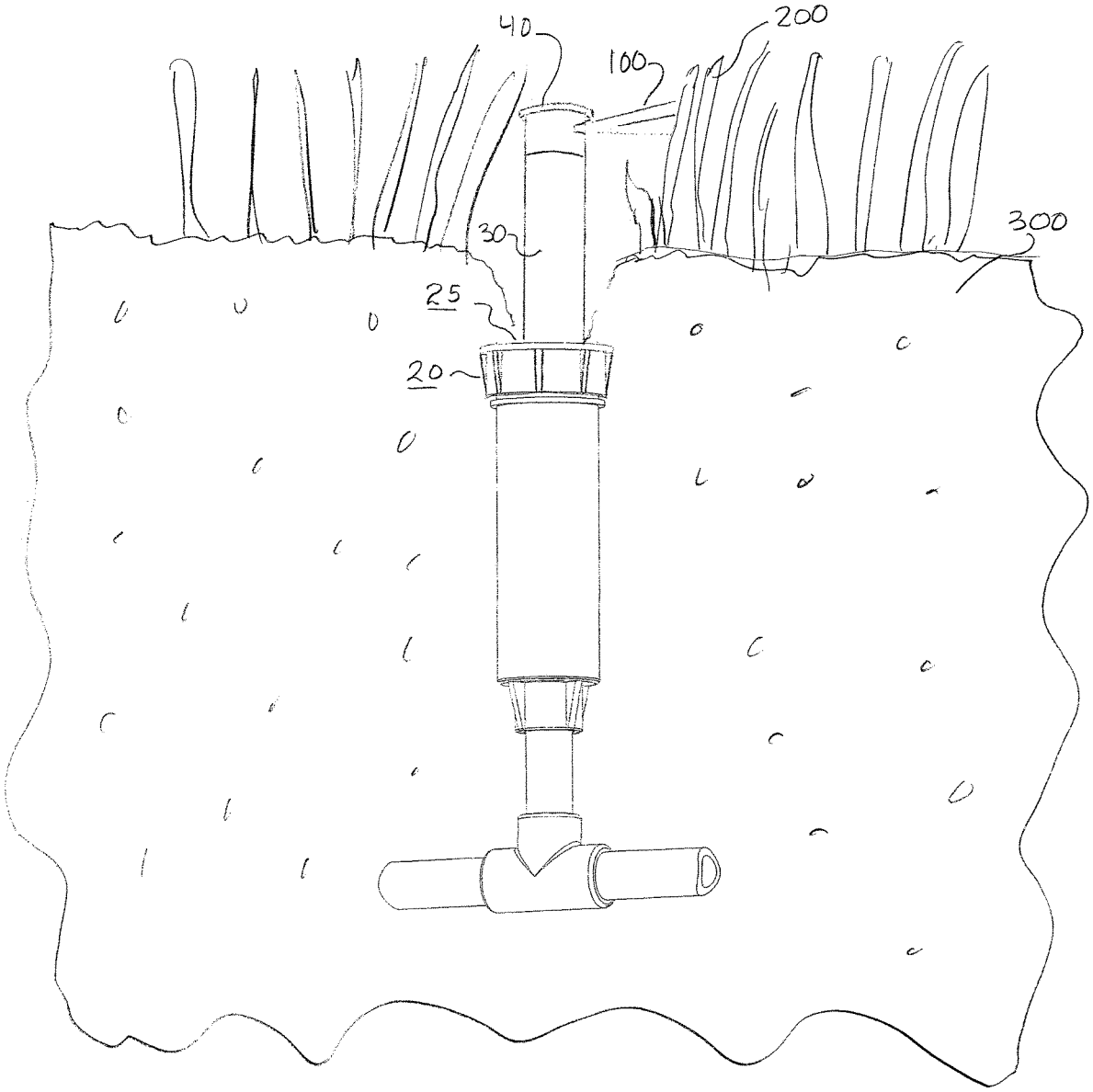
FIG. 2 is a side view illustrating a spray head that is sunken (too deep) in a lawn and with its pop-up spray stem extended.

FIG. 2 illustrates the same spray head 500 after soil 300 has built up higher than cap 20. Because spray head 500 is sunken in soil 300, spray stem 30 is not able to send water spray 100 over adjacent grass 200 when the spray stem is in its extended position as shown. Spray head 500 can no longer perform its intended function of irrigating a large area of lawn or other vegetation. Furthermore dirt and sand can restrict the movement of the spray stem through the cap and can wear out wiper seal 25.

Figure 3:
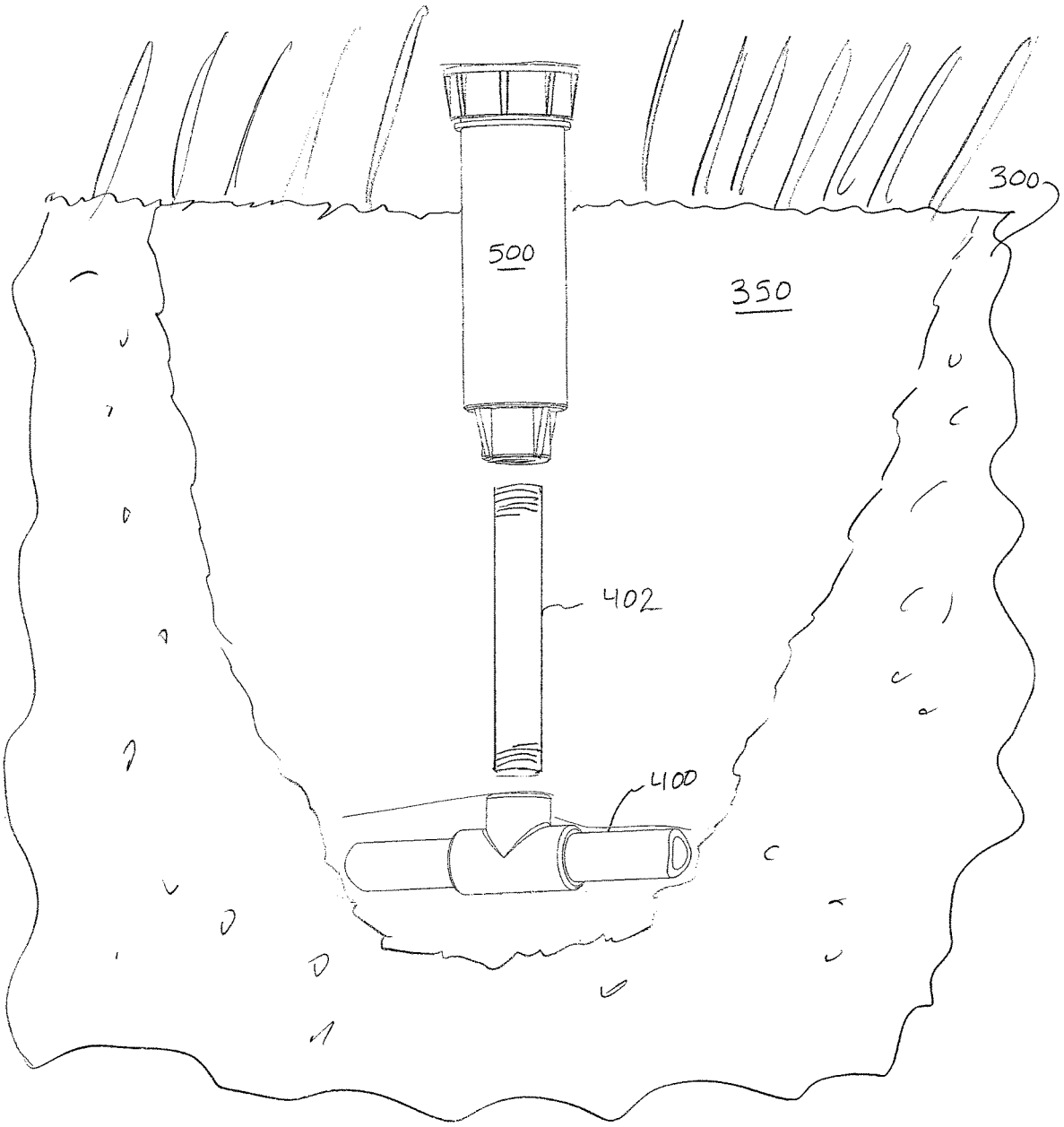
FIG. 3 is a side view illustrating a spray head with a riser pipe as commonly used to raise the spray head to the proper depth in a lawn.

FIG. 3 illustrates the repair procedure commonly used to raise spray head 500 back to its proper installed depth. A large amount of soil 300 is removed to form a trench 350 that extends below water supply 400. A longer threaded riser pipe 402 replaces the shorter pipe nipple 401 (not shown here but shown in FIG. 1) to connect water supply 400 to spray head 500.

One problem with this common repair procedure is that sufficient soil must be removed so that digging is possible under the spray head's connection to water supply 400. If trench hole 350 is not dug deep enough and wide enough, dirt, sand and other contaminants can fall into the water supply connection when the spray head is removed. These contaminants now in the water supply will plug the small orifices in nozzles in spray heads hampering irrigation. Digging a hole this large is time consuming and can take a half hour or more when the soils are rocky, are compacted or are mostly clay.

A second problem with this common repair procedure is that the hole can fill with water when the spray head is removed as the water supply empties. It may take an hour or more in hard soils for the water to drain back down under the spray head connection to permit cleaning of the threads and avoiding soil contamination in the supply system.

A third problem with this common repair procedure is that digging a hole this size necessitates that a sizeable amount of grass must be cut out and removed, which can kill much of the grass.

A fourth problem with this common repair procedure is that digging a hole this deep can damage the water supply pipe or damage shallow underground wiring including cables and landscape wiring.

Figure 4:
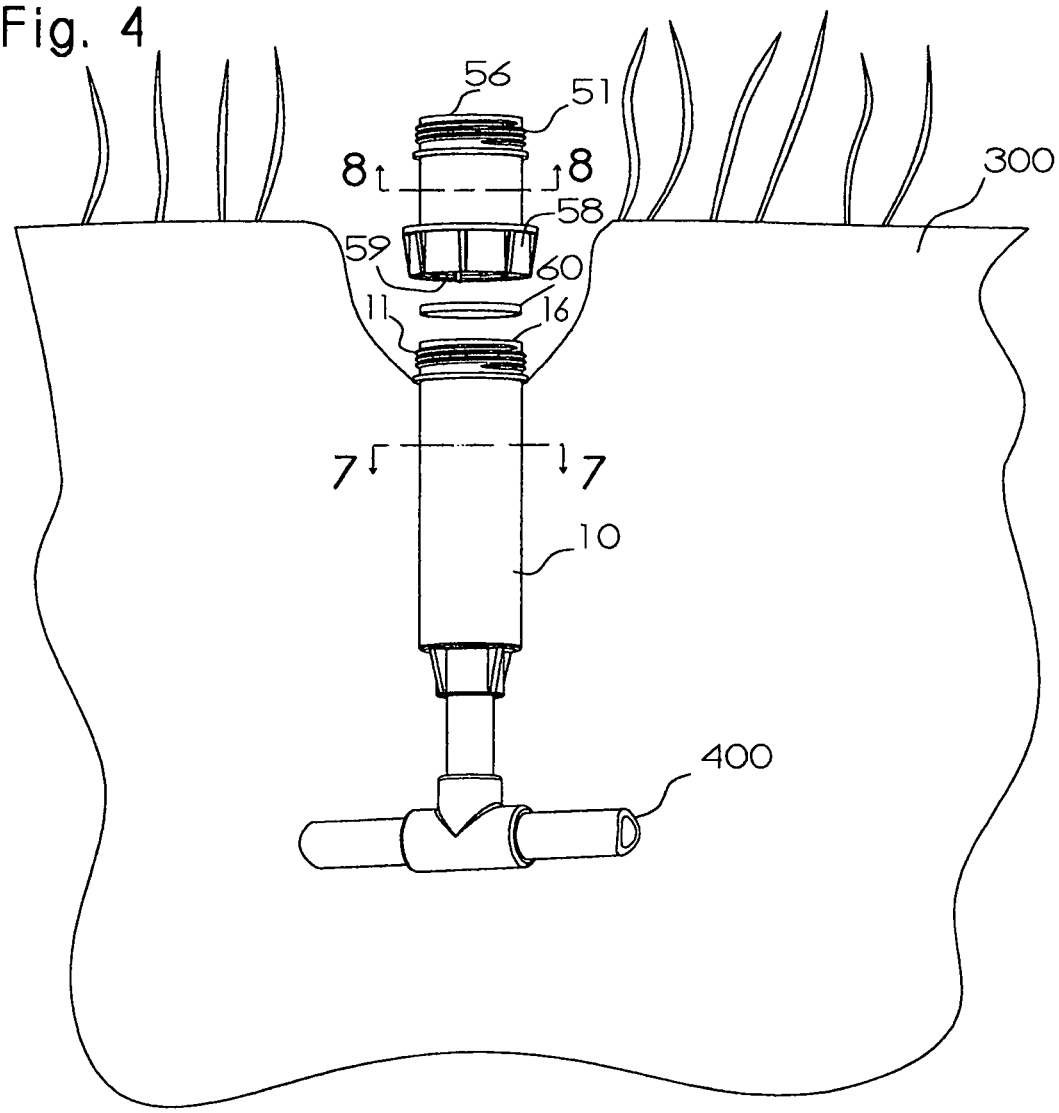
FIG. 4 is a side view illustrating a spray head with a spray head body extension of the present invention.

FIG. 4 illustrates the same sunken spray head of FIG. 3 but with the cap removed. Spray head body extension 50, hereafter called body extension 50 for brevity, is designed to screw onto the external threads 11 of body 10. Gasket 60 is used when needed to seal body 10 to body extension 50 when properly installed and aligned. Sealing surface 56 on body extension 50 is identical to sealing surface 16 on body 10 and external threads 51 on body extension 50 are identical to external threads 11 on body 10 thereby enabling cap 20 (not shown) to be attached to body extension 50. Compared to FIG. 3, only a small amount of soil 300 needs to be removed to effectively repair and raise the sunken spray head.

Figure 5:
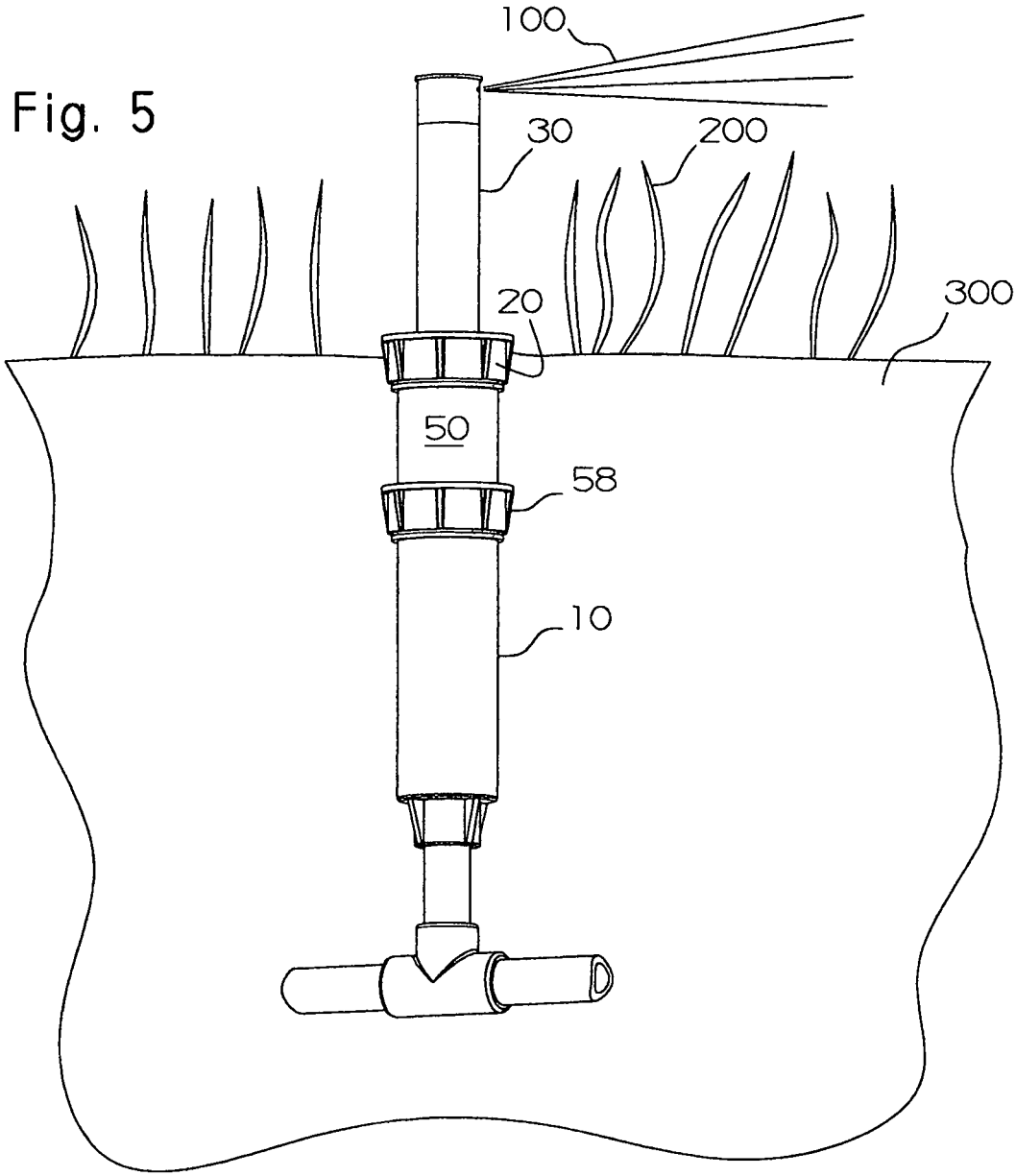
FIG. 5 is a side view illustrating a spray head with a spray head body extension of the present invention installed with its pop-up spray stem extended.

FIG. 5 illustrates a spray head with body extension 50 of the present invention installed to raise cap 20 to the proper depth in soil 300. Collar nut 58 is screwed onto body 10 and cap 20 is screwed onto body extension 50. Pop-up spray stem 30 is shown in its extended position wherein water spray 100 is able to be properly directed over grass 200. The present invention enables a quick, easy and efficient solution to the repair of sunken spray heads.

Figure 6:
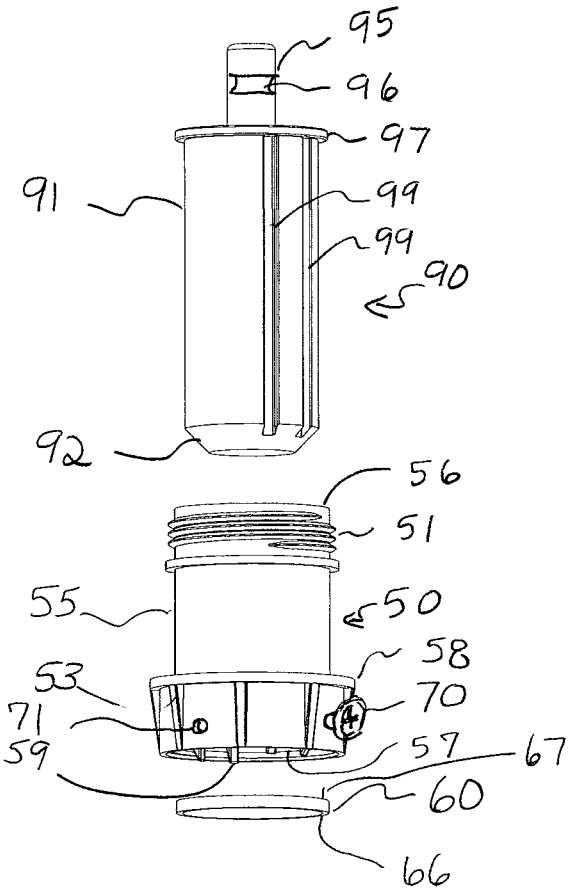
FIG. 6 is a side view illustrating a one-piece spray head body extension of the present invention with a plurality of set screw holes, a set screw, a gasket and an alignment tool.

FIG. 6 illustrates a body extension 50 that is the one-piece embodiment of the present invention. Collar nut 58 is integral with body extension housing 55. Also shown are set screw 70, gasket 60 and alignment tool 90.

Body extension housing 55 is an elongate hollow cylindrical structure with dimensions similar to the bodies of common pop-up sprinklers. The body extension housing and collar nut can be made of injection molded plastics. When attached to a common pop-up lawn sprinkler, the body extension enables the spray head's pop-up spray stem and cap to be raised to or above the surrounding soil without the need to dig down below the spray head.

Figure 7:
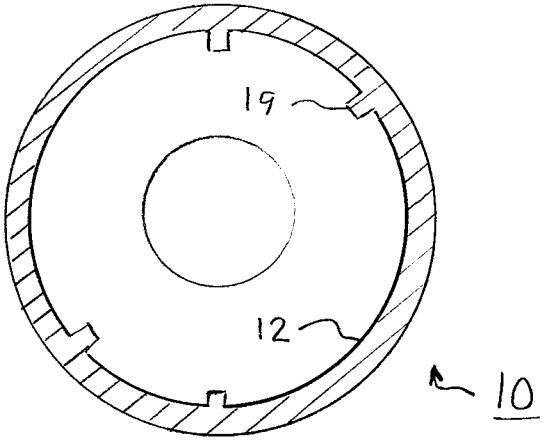
FIG. 7 is a cross section of a spray head body with four internal guide ridges.
Figure 8:
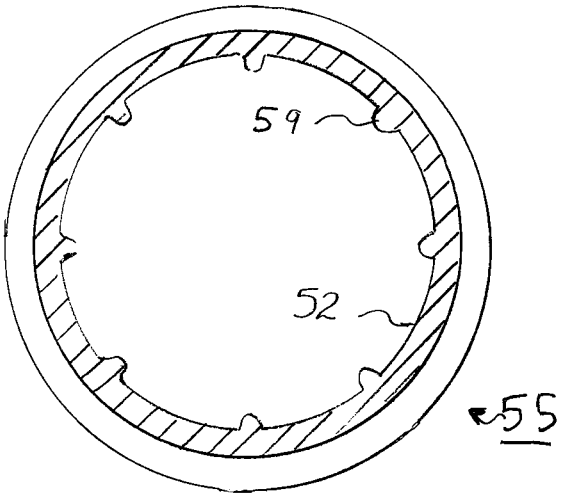
FIG. 8 is a cross section of a spray head body extension with eight internal guide ridges.

To explain the function and structure of alignment tool 90, please now refer to FIG. 7 and FIG. 8. FIG. 7 is a cross sectional view of spray head body 10. Spray head bodies have internal guide splines 19 that are comprised of elongate ridges on the internal cylindrical surface 12 of spray head body 10. These guide splines engage slots in a guide ring that is affixed to the lower end of the spray stem (not shown in this figure). The guide splines prevent the pop-up spray stem from rotating with respect to the spray head body as the spray stem extends and retracts, thereby preserving the spray position it was set to during or after installation. Four guide splines 19 placed in two pairs opposite each other are used in most spray head bodies. The guide splines are typically 45° apart. However the two guide splines in each pair of guide splines in the Rain Bird® Series 1800 spray head bodies are approximately 43.5 degrees apart from each other. These spray heads are very widely used. The Rain Bird website states that the 1800 Series Spray Heads are the "The #1 Irrigation Spray Head in the World." Rain Bird part number 1804HDS spray head is a good example of their most popular spray heads.

FIG. 8 shows guide splines 59 of a body extension. These guide splines have the same purpose and are comprised of elongate ridges on the internal cylindrical surface 52 of the body extension housing 55. The guide splines run parallel to the axis of the body extension housing and extend downward from the body extension housing's internal cylindrical surface to a point beyond the lower sealing surface (shown in FIG. 11).

In manufacture, spray head bodies do not maintain a consistent angular relationship between the cap threads and the guide splines. Therefore it is not possible to manufacture a one-stocking-unit integral nut embodiment of the body extension whose guide splines will always align with the guide splines of spray head body when installed and tightened. FIG. 8 shows the guide splines of an integral nut embodiment of the body extension. Eight guide splines 59 ensure alignment of four of these splines with the four splines of the spray head body (shown in FIG. 7) when it is tightened on the spray head housing. These eight guide splines are all equally 45° apart. The additional four guide splines in the body extension that will not align with the guide splines of the spray head body do not interfere with the movement of the stem as it is extended or retracted.

The eight equally spaced guide splines of the integral nut embodiment of the body extension permit an alignment with the spray head body splines every 45° rotation of the body extension on the spray head body. When the body extension is installed on the spray head body and tightened until resistance is felt as the gasket is compressed, a maximum of 45° of further tightening is required to achieve alignment of the splines. This creates a maximum of 0.015 inch of compression on the gasket with the thread pitch employed by spray head bodies. For a 0.090 thick standard NBR (Bung) o-ring, this is a satisfactory maximum 17% compression.

Figure 9:
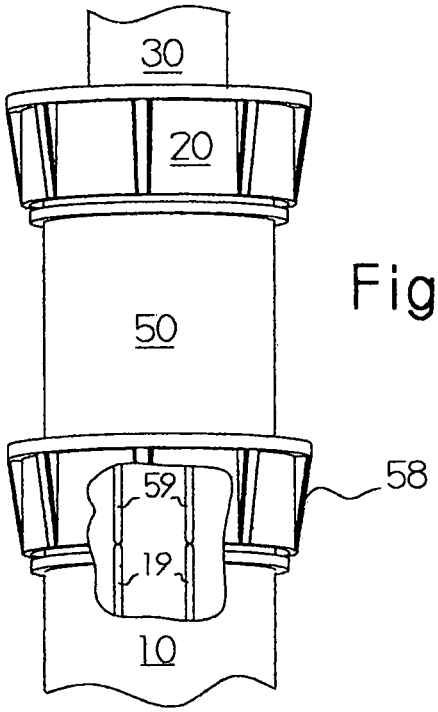
FIG. 9 is a cut away view of a spray head body extension installed on a spray head body showing a pair of their respective guide ridges in alignment.

Because each pair of the guide splines in a Rain Bird® body housing are 43.5 degrees apart, they are closer together than the guide splines of the integral nut embodiment of the body extension which are 45° apart. As seen in FIG. 9, the increased width of guide splines 59 of the body extension can fully cover the width of guide spines 19 of the Rain Bird body housing. This prevents the guide ring of the stem from getting caught on the upper end of spines 19 of the spray head body when the guide ring is sliding down over the splines as the stem is being retracted. This is critical for complete retraction of the stem because the relatively weak force from the stem spring needs to overcome the friction of the wiper seal. Any additional interference can prevent the stem from completely retracting. As the stem is being extended (moved upward), the guide ring can slide over wider splines 59 of the body extension because the ends of those splines are rounded and because the water pressure exerts sufficient force on the stem during extension to overcome any minor frictional interference.

Figure 10:
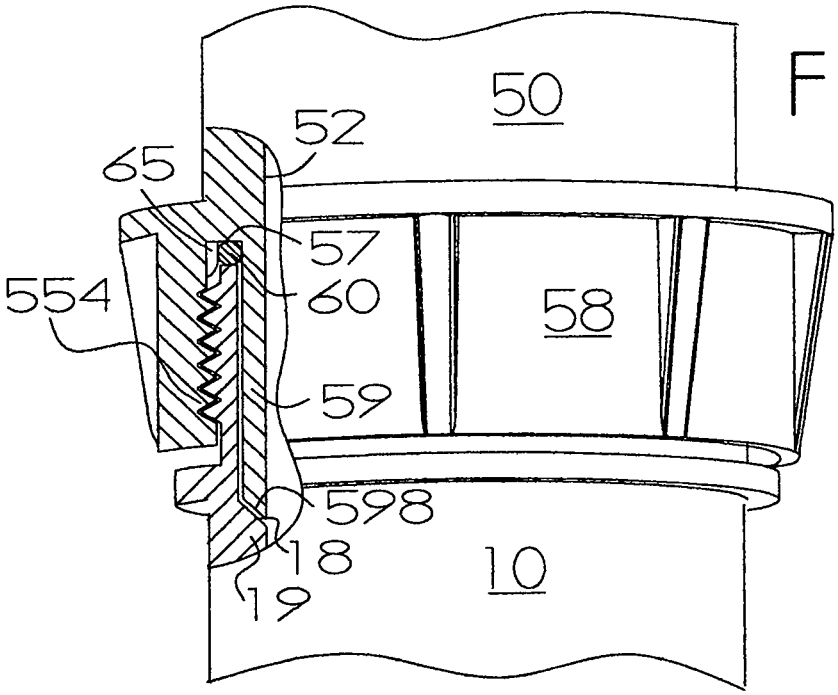
FIG. 10 is a cross section view of a spray head body extension installed on a spray head body with their respective guide ridges in alignment.

FIG. 10 illustrates how guide splines 59 of body extension 55 extend beyond lower sealing surface 57 and internal threads 554. This permits guide splines 59 of the body extension to be in close proximity to guide splines 19 of the spray head body when installed and thereby eliminate the chance of the guide ring becoming jammed as it slides from one set of guide splines to the other. To further ensure that the guide ring does not catch or jam between the guide splines, ends 598 of guide splines 59 of the body extension are formed in a complimentary angle to ends 18 of spray head body splines 19. This effectively creates a single longer uniform guide spline even though the guide splines of the body extension and the body do not contact each other. Ends 598 of guide splines 59 of the body extension are chamfered radially outward while ends 18 of spray head body splines 19 are chamfered radially inward.

Now that the function and structure of the guide splines have been discussed, the function and structure of the alignment tool is easier to understand. Alignment tool 90 (FIG. 6) is an elongate cylindrical structure. It has an outer diameter with a dimension that enables it to be slideably received inside body extension 50. Elongate grooves 99 on its outer cylindrical surface are parallel to the axis of the alignment tool. The grooves are positioned on the surface and dimensioned so that they slideably receive both the guide splines of body extension 50 and the guide splines of common pop-up spray head bodies. During installation of the body extension, it is tightened onto the spray head body (not shown in FIG. 6) until resistance is felt as gasket 60 is squeezed between the body and the body extension. The alignment tool is then inserted through the body extension and the body extension is further tightened onto the spray head body until the alignment tool falls into the spray head body. This ensures alignment of guide splines 59 of the body extension to guide splines 19 of the spray head body 10 (not shown in this figure). Alignment of the guide splines enables the pop-up spray stem and its guide ring to move freely through both the body extension and the spray head body.

Handle 95 enables tool 90 to be easily grasped during insertion and removal from the body extension. Grip groove 96 facilitates grasping of the handle when it is wet, dirty or slippery. Textured, knurled or other surface finishes are other means to facilitate gripping the shaft. The present invention also includes other means of grasping the tool, such as a ring.

Flange 97 prevents tool 90 from being inserted farther than is needed or from being inserted too far into body extension 50 and the spray head body.

Chamfered lower surface 92 facilitates insertion of tool 90 into body extension 50.

Alignment of the guide splines of body extension to the guide splines of the spray head body can alternately be achieved through use of the spray stem and guide ring in place of the alignment tool. After the body extension is installed onto the spray head body, the spray stem with its guide ring can be inserted through the body extension. The body extension is then further tightened onto the spray head body until the guide splines of the body extension are sufficiently aligned to the guide splines of the spray head body to enable the spray stem with guide ring to slide down into spray head body.

An effective alignment of the guide splines of body extension to the guide splines of the spray head body can also be achieved through using a flashlight to look down into the body extension and spray head body to see the relative alignment of their guide splines. The spray head body extension is then further tightened (rotated) to the spray head body if needed to improve guide spline alignment. Once guide splines are aligned, the stem and cap can be re-installed and tightened. Now that the guide splines and alignment tool are described, the following descriptions refer to FIG. 4, FIG. 5 and FIG. 6. for further details of the one-piece embodiment of the body extension.

FIG. 6 shows additional detail of the structure of body extension 50. Upper external threads 51 are located on the upper end of body extension housing 55. Upper external threads 51 are dimensioned to be the same as external threads 11 (FIG. 4) on common pop-up spray head bodies and thereby enable attachment to cap 20 (FIG. 5) of common pop-up spray heads.

FIG. 6 also shows upper sealing surface 56 is located on the upper end of body extension housing 55. The upper sealing surface is dimensioned to be the same as sealing surface 16 on spray head body 10 (FIG. 4) and thereby enable sealing to common body caps 20 (FIG. 5) of spray head bodies 10.

Collar nut 58 is located on the lower end of body extension housing 55. The collar nut has internal threads that are dimensioned to be the same as the internal threads on cap 20 (FIG. 5) of spray head 500 (shown in FIG. 3) and thereby enables attachment of body extension 50 to spray head body 10 (FIG. 4). In the one-piece embodiment of the present invention, collar nut 58 is integral with the body extension housing 55. In the multi-piece embodiment of the present invention, the collar nut is separate from the body extension housing. This multi-piece embodiment will be shown later in FIG. 11.

Grip ridges 53 (FIG. 6) are located on the external surface of collar nut 58 to facilitate gripping the body extension 50 when it is wet, dirty or slippery to enable rotating it to tighten or untighten it from spray head body 10 (shown in FIG. 5).

Lower sealing surface 57 (FIG. 6) is on the lower end of body extension housing 55. The lower sealing surface is dimensioned to be the same as lower sealing surface on cap 20 and thereby enable sealing of body extension 50 to spray head body 10 (shown in FIG. 4) when they are assembled together to prevent water leaking at those surfaces.

FIG. 6 shows gasket 60, a ring-shaped element that is made of pliable material. It is dimensioned so that its top surface 67 contacts and seals against lower sealing surface 57 on the lower end of body extension housing 55 and its bottom surface 66 contacts and seals against sealing surface 16 (FIG. 4) on spray head body 10 (FIG. 4). The gasket functions to seal these two surfaces when necessary to prevent excessive water leakage. A second function is to permit additional rotation of integral collar nut 58 and body extension housing 55 after contacting gasket 10 by means of compression of the gasket to enable guide splines 59 of body extension housing 55 to align with guide splines 59 (not shown) of spray head body 10.

FIG. 10 illustrates one means for holding gasket 60 held in place inside body extension 55. The illustrated means is a friction fit between guide splines 59 and collar nut 58. The friction fit can be accomplished by protrusions 65 on collar nut 58 or alternately on guide splines 59. The protrusions extend downward from sealing surface 57 by more than the radius of the gasket to contact the gasket at its widest point if the gasket is an o-ring. The protrusions extend downward from sealing surface 57 by less than the thickness of the gasket so that they are not contacted by upper end of housing 10 when collar nut 58 is tightened and the gasket is compressed. Alternate means of gasket retention include tabs, bumps and fingers.

Set screw 70 is tightened after alignment of guide splines 59 of body extension 50 to the guide splines 59 (not shown) of spray head body 10 after installation of body extension 50 to spray head body 10. The frictional contact of tightened set screw 70 between body extension 50 and spray head body 10 prevents additional rotation of body extension 50 with respect to spray head body 10 when cap 20 is later installed and tightened. Any additional rotation of body extension 50 with respect to spray head body 10 when cap 20 is later installed and tightened would cause guide splines 59 of body extension 50 to go out of alignment with guide splines 59 (not shown) of spray head body 10 causing interference of the movement of the stem between body extension 50 and spray head body 10 as it tries to extend or retract.

Additional set screw holes 71 enable the set screw to be installed in different locations. When a set screw hole ends up being positioned next to a sidewalk or other obstruction when the body extension is tightened on the spray head body, it is difficult to tighten the set screw with a screw driver. Additional set screw holes are advantageous because they allow easy access for installing and tightening a set screw regardless of nearby obstructions.

The procedure for repairing sunken spray heads using the one-piece (integral collar nut) embodiment of the present invention is as follows. A small amount of soil is removed or pushed aside if necessary to unearth the upper end of the spray head body. The cap is unscrewed and removed along with the spray stem. The body extension and gasket are installed on the spray head body and tightened until compression of the gasket is felt. The installer looks down into the body extension and spray head body, using a light source when necessary, to see the relative alignment of their guide splines. The body extension is then further tightened if needed to improve alignment of the guide splines. After the guide splines are aligned, the stem and cap are re-installed and tightened.

Alternately, the alignment tool can be used in place of the spray stem during installation of the body extension to facilitate alignment of the guide splines of the body extension to the guide splines of the spray head body.

A set screw can be employed and tightened after the alignment of guide splines to prevent them from becoming misaligned when the cap is tightened.

Figure 11:
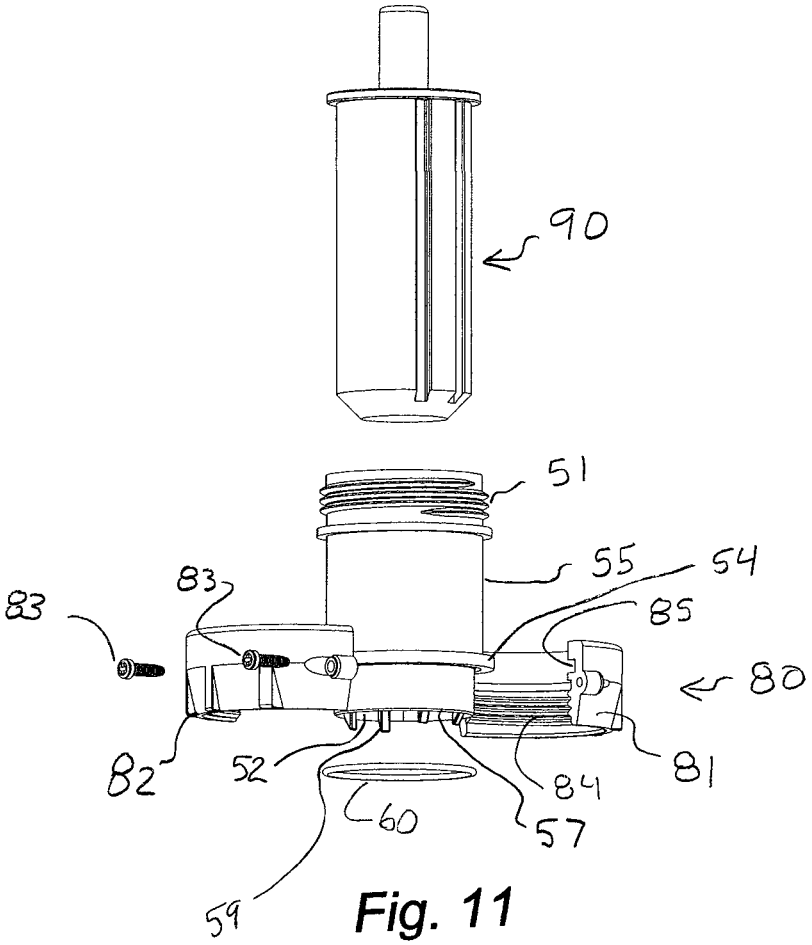
FIG. 11 is a side view illustrating a multi-piece spray head body extension of the present invention with split-nut union, gasket and alignment tool.

FIG. 11 illustrates a multi-piece embodiment of the body extension of the present invention with split-nut union 80, screws 83, gasket 60 and alignment tool 90

The split-nut union half with larger screw holes 82 is fixedly joined to the split nut union half with smaller screw holes 81 by self-threading screws 83. An annular groove 85 in split-nut assembly 80 loosely traps a nut flange 54 of body extension housing 55. This permits the split-nut assembly to rotate on the body extension housing but not to move axially with respect to the body extension housing. Internal threads 84 are dimensioned to be the same as the internal threads of cap 20 (FIG. 5) of spray head body 10 (FIG. 5) and thereby enable attachment of the split nut assembly 80 to spray head body 10 (FIG. 5).

Other means for fixedly joining the two halves include press-fit dowel pins and receiving holes, or paired latch assembles similar to those used to hold electrical connectors together.

Prior to installation, the split unions are fixedly attached to each other over the body extension housing by the manufacturer or by the installer.

The two halves of the split-nut union enable manufacture in an injection mold that does not require an expensive rotating ejection assembly to remove the union from the mold.

Sealing surface 57 at the lower end of body extension housing 55 is dimensioned to be the same as the lower sealing surface on body cap 20 and thereby enable sealing body extension housing 55 to spray head body 10 (FIG. 4) when attached together.

The procedure for repairing sunken spray heads using the multi-piece embodiment of the present invention is as follows. A small amount of soil is removed or pushed aside if necessary to unearth the upper end of the spray head housing. The cap is unscrewed and removed along with the spray stem. The body extension is installed on the spray head body and the split-nut union is tightened until snug. The installer inserts the alignment tool and rotates the body extension until the tool slides down into the spray head body, indicating that the splines are aligned. The split-nut union is fully tightened and the alignment tool is removed. The cap with spray stem is assembled onto the body extension and tightened.

The separate collar nut can be fully tightened when the body extension is in any alignment position with respect to the spray body. This permits the body extension to be designed with guide splines identical in dimensions and angular relationships to the guide splines of the spray body it is to be installed on. As one example, a body extension can be designed with two pairs of guide splines that are identical in width and angular relationship to Rain Bird® spray bodies.

Another advantage of the multi-piece embodiment is that a gasket is not necessarily needed. Alignment of the guide splines is not dependent on the position of the split union. Therefore the split union can be fully tightened. This produces a sufficient seal between the housing extension and spray body. The cap and spray body seal in the same way without employing a gasket.

For more than fifty years, hundreds of millions of spray heads have been used. During these many decades, no invention has been created for effectively and quickly repairing the common problem of sunken spray heads in the millions of residential and commercial applications. This invention is clearly new and useful. Moreover, it was not obvious to those of ordinary skill in this art at the time it was made.

It will thus be seen that the objects set forth above, and those made apparent from the foregoing description, are efficiently attended. Since certain changes may be made in the foregoing construction without departing from the scope of the invention, it is intended that all matters contained in the foregoing construction or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall there between.

What is claimed is:

1. A spray head body extension that is screwed onto an upper end of a spray head body after a cap with a spray stem is removed, comprising:

an elongate hollow cylindrical body extension housing having an internal diameter, an external diameter, an internal cylindrical surface, an external cylindrical surface, an upper end and a lower end, an upper sealing surface on the upper end, a lower sealing surface on the lower end, an external thread on the external cylindrical surface of the upper end, enabling attachment of the cap, a collar nut on the external cylindrical surface of the lower end of the body extension housing, the collar nut having an internal thread, enabling attachment to a spray head body, and a plurality of elongate ridges on the internal cylindrical surface of the body extension housing comprising guide splines, wherein the guide splines run parallel to an axis of the body extension housing and extend downward from the internal cylindrical surface to a point beyond the lower sealing surface, whereby the guide splines prevent the spray stem from rotating from a set spray position, wherein the collar nut is integral with the elongate hollow cylindrical body extension housing whereby both the collar nut and the elongate hollow cylindrical body extension housing are made as a single piece by an injection mold or 3D printer, wherein the elongate ridges are eight ridges 45 degrees apart from the adjacent ridge, wherein the elongate ridges have a width in the range of 0.070 to 0.130 inch, wherein the elongate ridges each have a lower end that is chamfered radially outward, wherein the collar nut further comprises a plurality of set screw holes on an external surface that extends radially inward through the collar, a set screw whereby, after installation of the body extension onto the spray head body, tightening the set screw frictionally contacts the spray head body and locks the collar nut to the spray head body to prevent rotational movement of the body extension with respect to the spray head body to preserve alignment of the guide splines, and a circular compressible gasket to aid in sealing the lower sealing surface, and whereby the compression of the gasket enables the body extension to be tightened and thereby rotated further with respect to the spray head body when needed to align the guide splines of the body extension to guide splines in the spray head body.

2. The spray head body extension of claim 1, wherein the circular compressible gasket for the lower sealing surface is a rubber o-ring.

3. A spray head body extension that is screwed onto the upper end of a spray head body after a cap with a spray stem is removed, comprising:

an elongate hollow cylindrical body extension housing having an internal diameter, an external diameter, an internal cylindrical surface, an external cylindrical surface, an upper end and a lower end, an upper sealing surface on the upper end, a lower sealing surface on the lower end, an external thread on the external cylindrical surface of the upper end, enabling attachment of the cap, a collar nut on the external cylindrical surface of the lower end of the body extension housing, the collar nut having an internal thread, enabling attachment to a spray head body, wherein the collar nut is separate from the elongate hollow cylindrical body extension housing wherein the collar nut can rotate with respect to the elongate hollow cylindrical body extension housing, and a plurality of elongate ridges on the internal cylindrical surface of the body extension housing comprising guide splines, wherein the guide splines run parallel to the axis of the body extension housing and extend downward from the internal cylindrical surface to a point beyond the lower sealing surface, whereby the guide splines prevent the spray stem from rotating from a set spray position, wherein the elongate ridges are eight ridges 45 degrees apart from the wherein the elongate ridges have a width in the range of 0.070 to 0.130 inch, wherein the elongate ridges each have a lower end that is chamfered radially outward.

4. The spray head body extension of claim 3 further including:

a flange on the external cylindrical surface of the elongate hollow cylindrical body extension housing in proximity to the lower end, an annular grove on the internal surface of the collar nut that receives the flange, wherein the collar nut can rotate with respect to the extension body but is prevented from moving axially with respect to the extension body, a first half, and a second half, whereby the collar nut is manufactured in an injection mold without need for a rotating ejection assembly and wherein the first half and second half are assembled together onto the body extension housing.

5. The spray head body extension of claim 3 further including:

an elongate cylindrical alignment tool with an external cylindrical surface, an upper end, a lower end, the external cylindrical surface further including a plurality of elongate grooves that run parallel to the axis of the elongate cylindrical alignment tool wherein the grooves receive the guide splines of the spray head body and the guide splines of the body extension and hold the splines in alignment when the elongate cylindrical alignment tool is inserted through the body extension into the spray head body.

6. The spray head body extension of claim 5 further including:

a handle on the upper end whereby the elongate cylindrical alignment tool is manually grasped to facilitate inserting the elongate cylindrical alignment tool into the body extension, and to facilitate removing the elongate cylindrical alignment tool from the body extension, a chamfered surface on the lower end to facilitate inserting the elongate cylindrical alignment tool into the body extension, and a means for increasing grip on the upper end.

7. A method for repairing a sunken spray head comprising the steps of:

a. unscrewing and removing a spray head cap and stem from a spray head body that has a plurality of guide splines on an internal cylindrical surface of the spray head body;

b. providing an elongate hollow cylindrical body extension that has a collar nut and a plurality of guide splines on an internal cylindrical surface of the body extension;

c. providing a body extension sealing gasket;

d. providing a body extension set screw;

e. installing the body extension and sealing gasket onto the spray head body;

f. rotating the body extension with respect to the spray head body until the guide splines of the body extension align with the guide splines of the spray head body;

g. tightening the body extension set screw;

h. installing the spray head cap assembly onto the body extension.

* * * * *